US005293020A

United States Patent [19]

Han et al.

[11] Patent Number: 5,293,020

[45] Date of Patent: Mar. 8, 1994

[54] MICROWAVE OVEN DOOR CONTROL DEVICE

[75] Inventors: Jangseop Han, Seoul; Jaeyong Lee, Incheon, both of Rep. of Korea

[73] Assignee: Daewoo Electronics Co., Ltd., Seoul, Rep. of Korea

[21] Appl. No.: 998,012

[22] Filed: Dec. 29, 1992

[30] Foreign Application Priority Data

Dec. 31, 1991 [KR] Rep. of Korea ..... 91-25636

[51] Int. Cl.[5] ..... H05B 6/68

[52] U.S. Cl. ..... 219/724; 219/739; 126/197

[58] Field of Search ..... 219/10.55 C, 10.55 D, 219/10.55 B; 126/197; 292/251.5; 200/61.62

[56] References Cited

U.S. PATENT DOCUMENTS

| | | | |
|---|---|---|---|
| 3,627,959 | 12/1971 | Chapell | 219/10.55 C |
| 3,784,776 | 1/1974 | Asanuma | 219/10.55 C |
| 4,309,585 | 1/1982 | Doi et al. | 219/10.55 B |
| 4,450,335 | 5/1984 | Shimizu et al. | 219/10.55 C |
| 4,461,940 | 7/1984 | Ishimura | 219/10.55 C |
| 4,982,063 | 1/1991 | Tsunekawa et al. | 219/10.55 C |
| 5,012,794 | 5/1991 | Faurel | 126/197 |

FOREIGN PATENT DOCUMENTS

| | | | |
|---|---|---|---|
| 60-33207 | 8/1985 | Japan . | |
| 980872 | 1/1965 | United Kingdom | 219/10.55 C |

*Primary Examiner*—Philip H. Leung
*Attorney, Agent, or Firm*—Thomas J. Dodd

[57] ABSTRACT

Disclosed is a microwave oven with an automatic door control device. Novel door latching/opening device which uses permanent magnets and electromagnets is provided in place of hook-type door latches and slots on a oven wall. Door state detector is also provided in which the existing permanent magnets and electromagnets rather than a separate mechanical switch are utilized to discriminate the door closed state from the door open state. Further, a processing device is employed to control the operation of the door latching/opening device and microwave energy generator in response to the input signals from the door state detector and the door open switch.

12 Claims, 9 Drawing Sheets

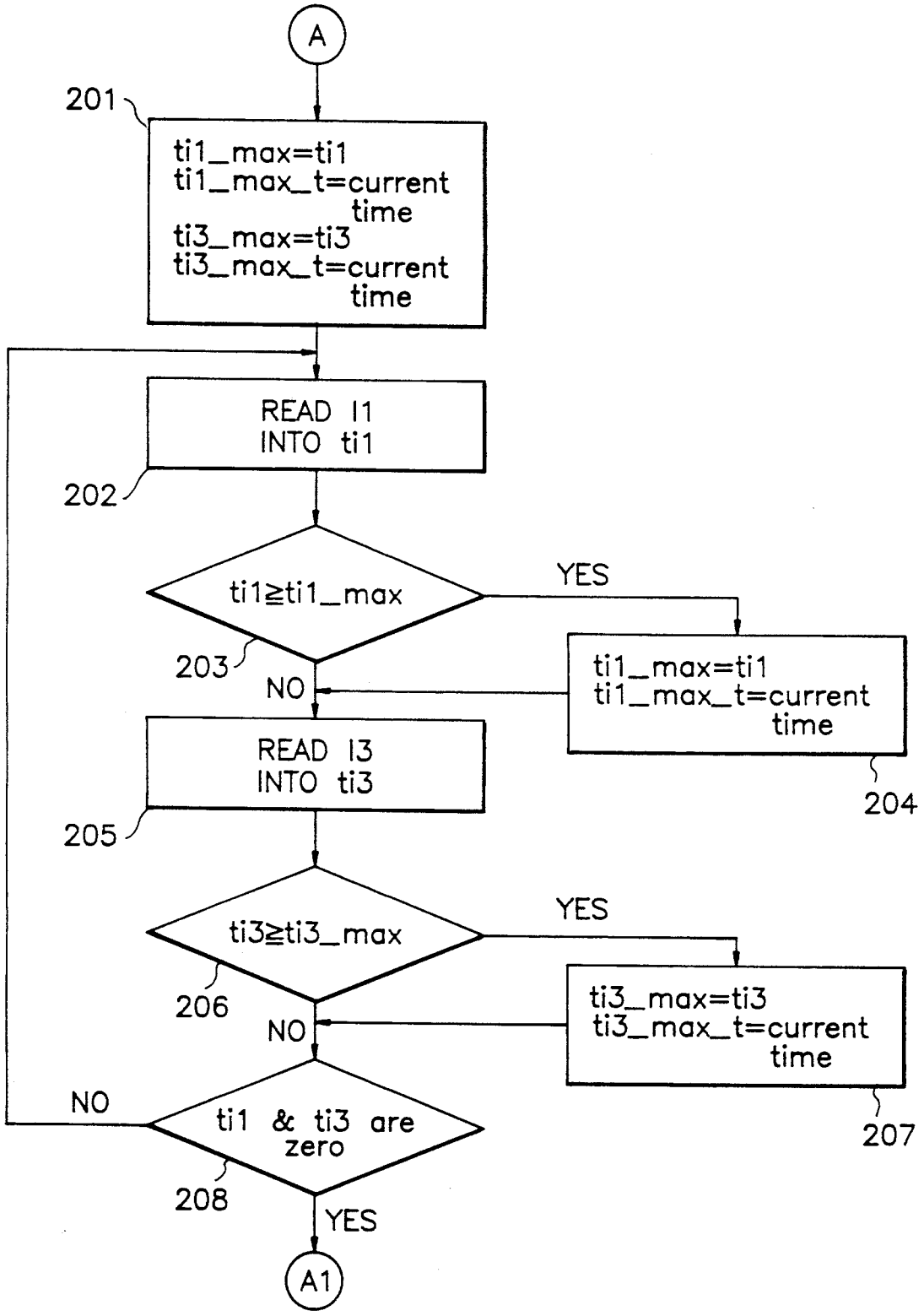
FIG. 4B1

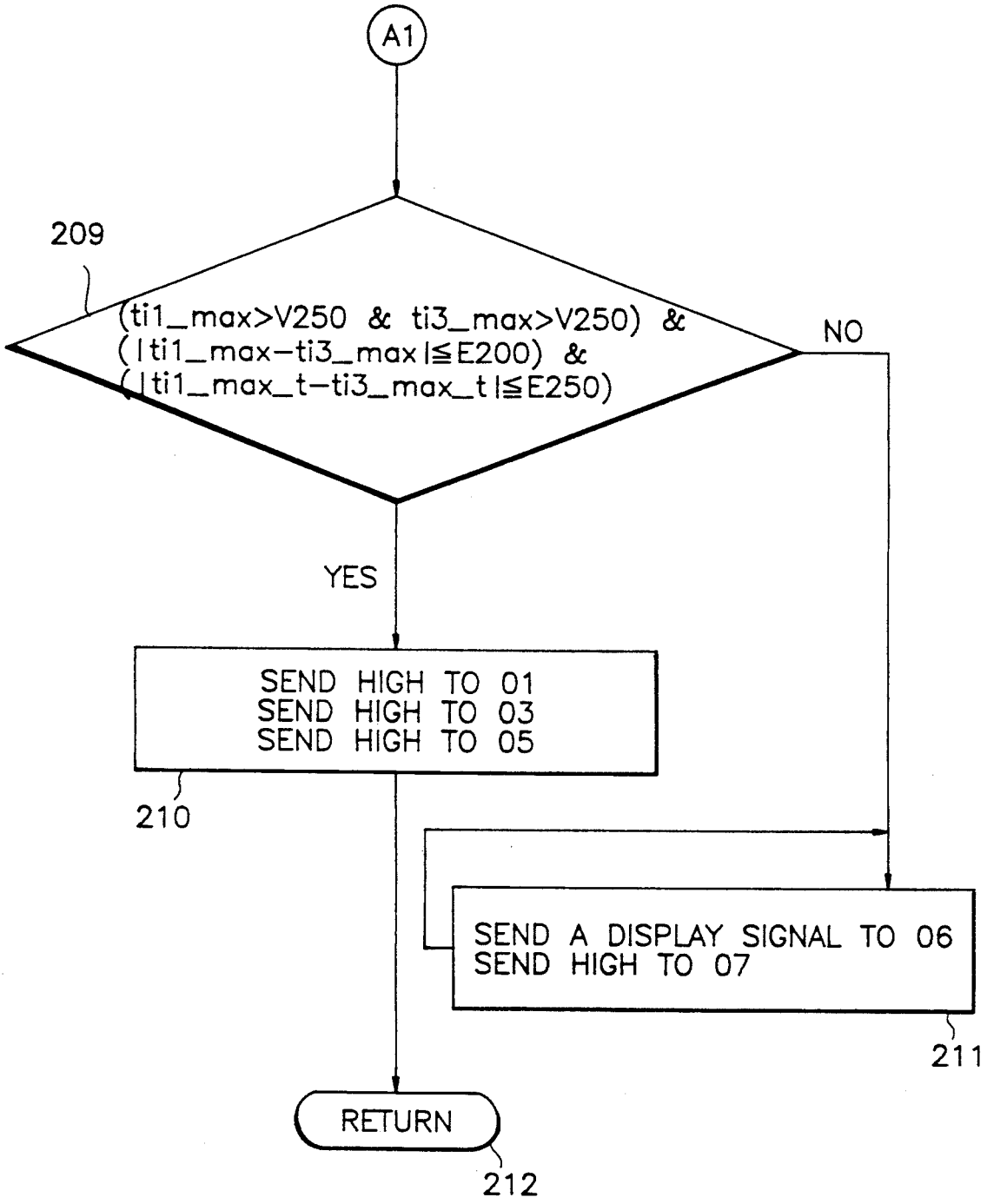
*FIG. 4B2*

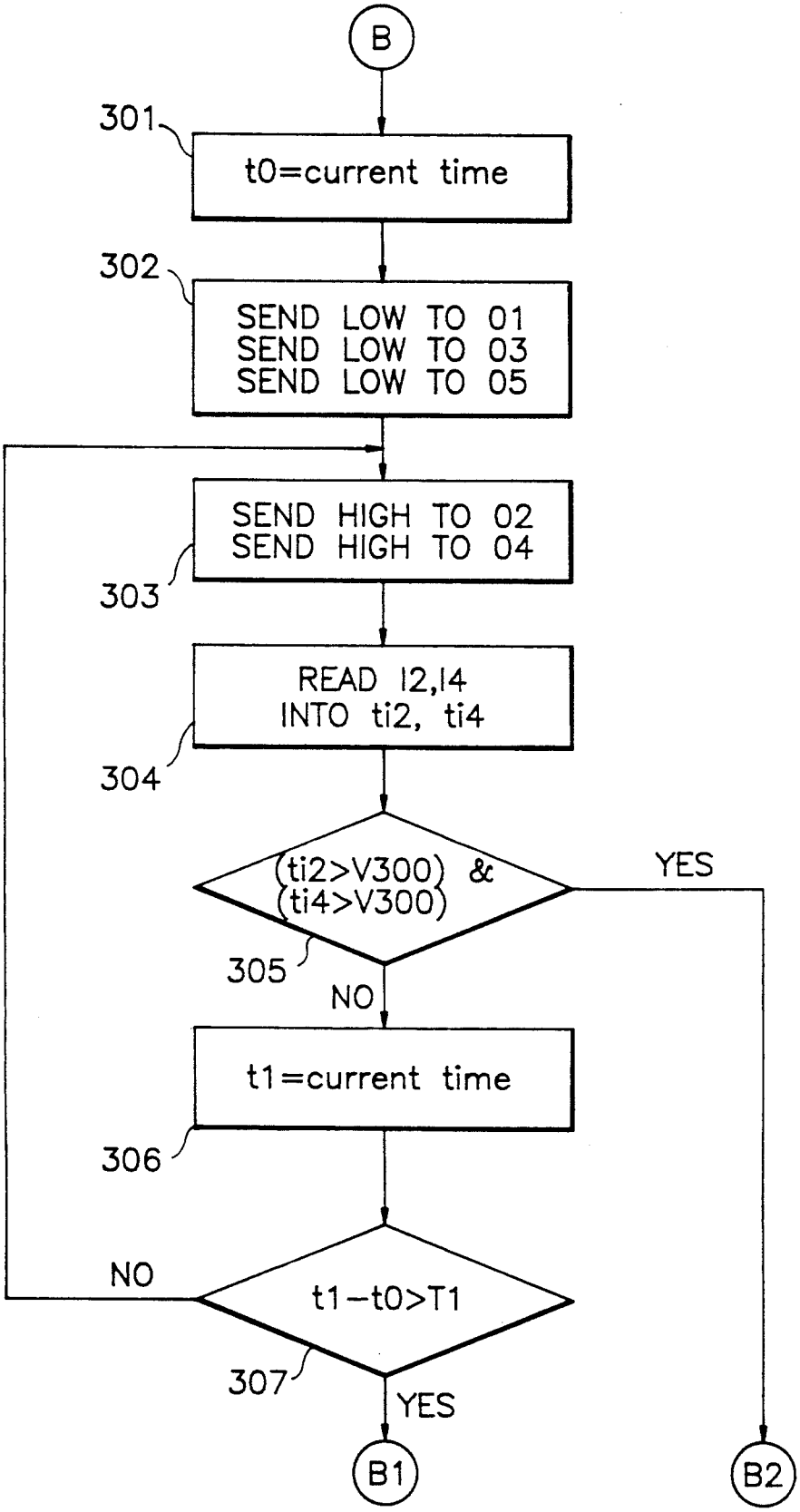
FIG. 4C1

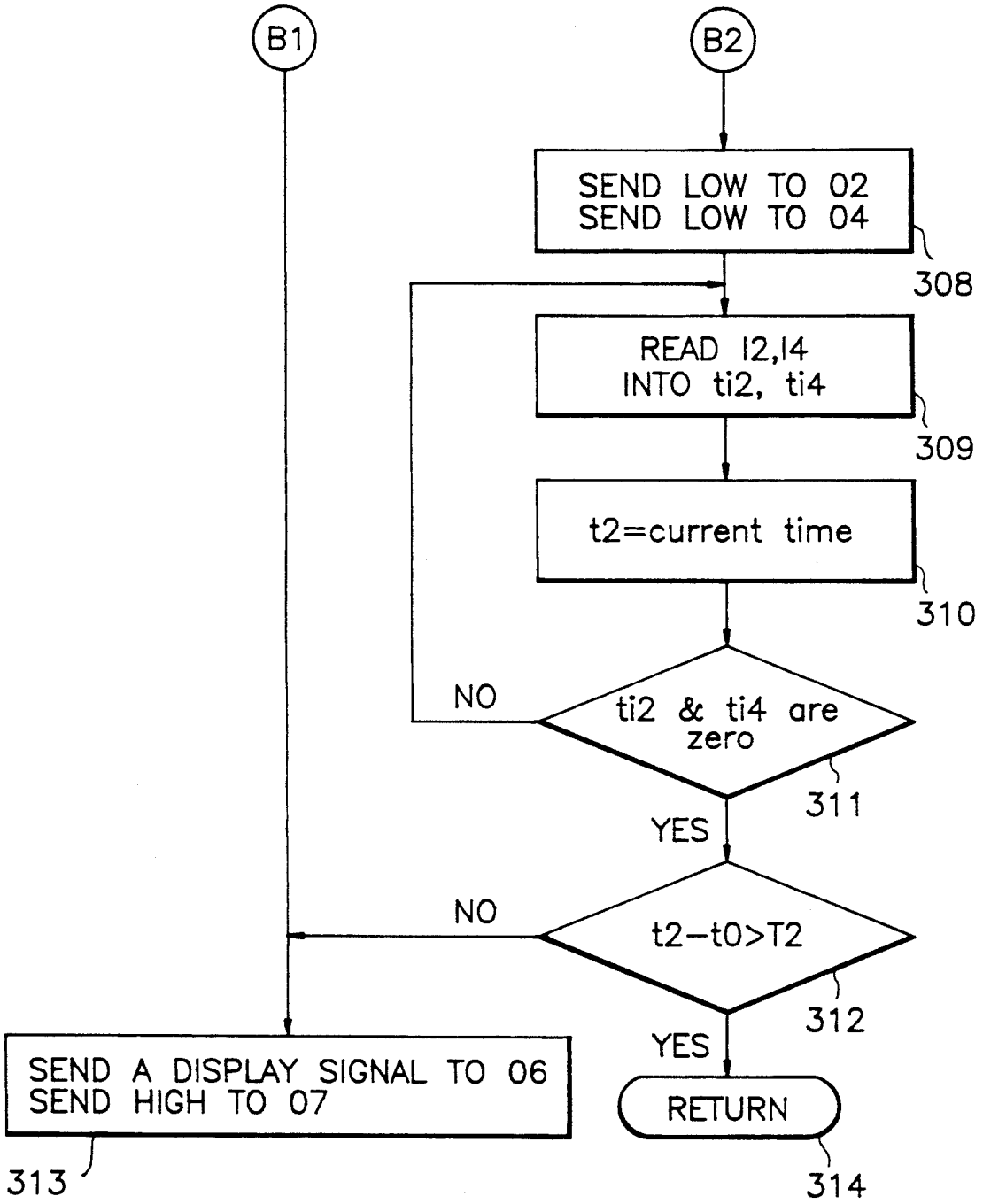
FIG. 4C2

MICROWAVE OVEN DOOR CONTROL DEVICE

FIELD OF THE INVENTION

The present invention relates to a microwave oven; and is more particularly concerned with a microwave oven door control device capable of accurately detecting a faulty state of the door and facilitating the latching and the opening operations of the door.

DESCRIPTION OF THE PRIOR ART

Generally, a microwave oven has a door to provide a user access to the interior(cavity) of the microwave oven. The door also prevents the leakage of electromagnetic radiation during the operation of the microwave oven.

A typical present day microwave oven employs hook-type door latches and slots on an oven wall in order to keep its door closed once the door is in the closed position. The door latches are usually secured in the locked position during the heating operation by means of mechanical locking structure or electrically actuated locking structure employing a solenoid. The microwave oven also has a mechanical or optical switch(or switches) which tells a closed state from an open state. The microwave oven can initiate and continue the heating operation only when the door is in the closed position. Two such arrangements are disclosed in U.S. Pat. No. 3,733,456 issued to Louis W. Blackburn and Japanese Patent Laid-open Publication No. 60-33207.

A problem with such arrangements is that it is difficult and cumbersome to equip a microwave oven door with the door latches and it is also cumbersome to form the slots on a oven wall.

Another problem with such arrangements is that the door assembly can easily be worn away due to the physical forces used to open and close the door.

SUMMARY OF THE INVENTION

It is, therefore, an object of the present invention to provide a microwave oven with a novel oven door latching/opening means which uses magnetic materials-(e.g., ferromagnetics or permanent magnets) and electromagnets in place of hook-type door latches and slots on a oven wall.

It is also an object of the present invention to provide a microwave oven with means for detecting the state of the door which utilizes the existing magnetic materials and electromagnets rather than employing a separate mechanical switch(or switches).

Another object is to provide such door latching/opening means which can be fabricated readily and relatively economically, and which has a durable operability.

The present invention provides a microwave oven with an automatic door control device, which comprises: an enclosure having therein a heating chamber adapted to receive an object to be heated; a door mounted at an opening of the heating chamber; at least one magnetic material provided at one side of the door; at least one electromagnet provided on the enclosure and adapted to contact with the magnetic material; at least one door state detecting means connected with the electromagnet for generating a first signal based on electromotive forces, said electromotive forces being generated in the electromagnet when the door is being closed or opened; a door open switch means for generating a second signal, said second signal being generated upon pressing a door open switch; a processing means for generating a control signal in response to the first signal and the second signal; at least one door latching and opening means connected with the electromagnet for latching and opening the door in response to the control signal, said door being latched while an electric current is applied to said electromagnet in one direction and opened when another current is applied to the electromagnet in another direction; a microwave energy generator adapted to radiate energy within the enclosure; and a load driving power switching means for operating the generator in response to the control signal.

BRIEF DESCRIPTION OF THE DRAWINGS

The above and other objects and features of the present invention will become apparent from the following descriptions given in conjunction with the accompanying drawings, in which:

FIGS. 4A, 4B1, 4B2, 4C1, 4C2 and 4D represent flowcharts which illustrate the operation of the processing means shown in FIG. 2.

DETAILED DESCRIPTION OF THE PREFERRED EMBODIMENT

Figure 1:
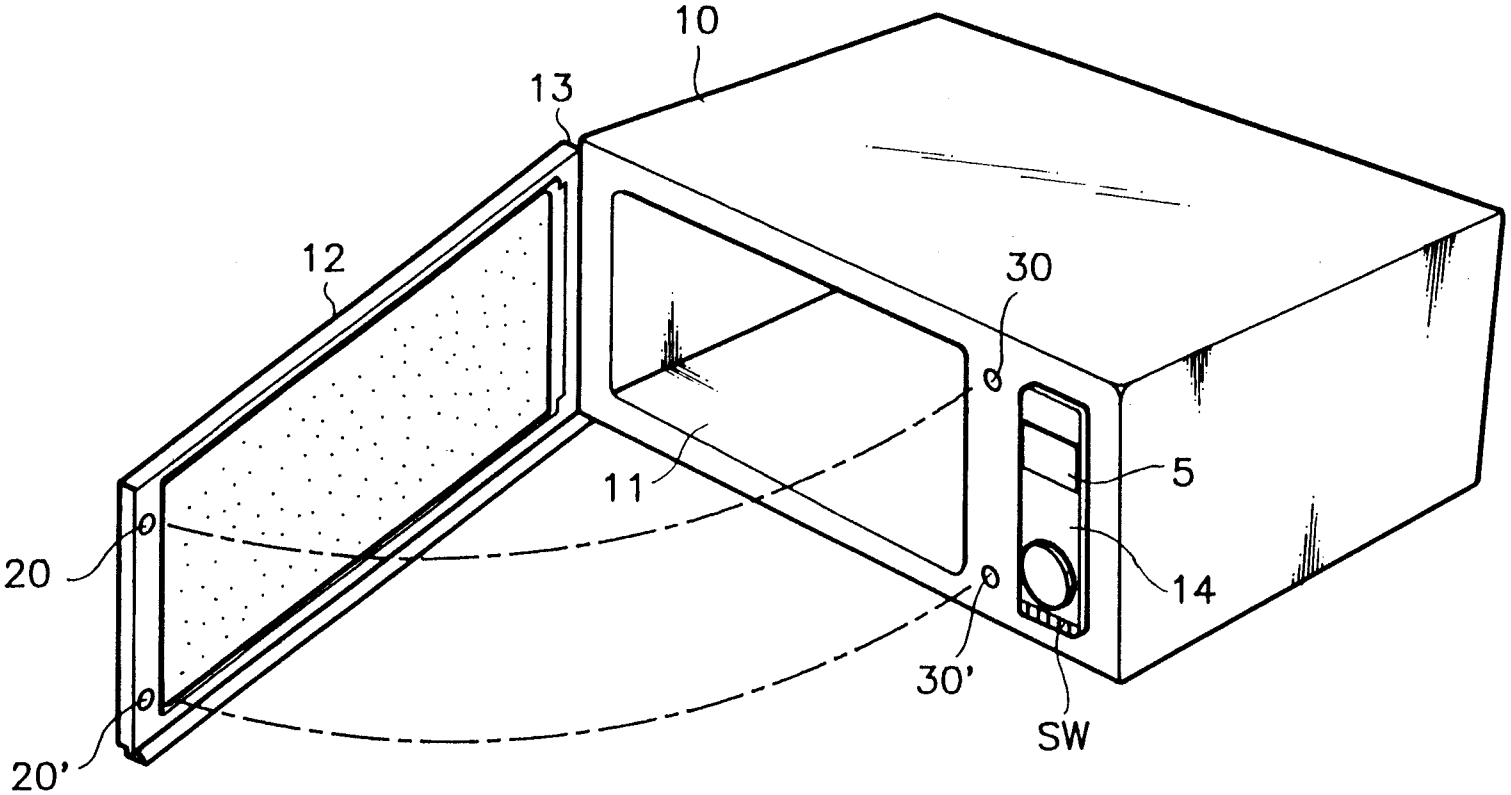
FIG. 1 shows a perspective view of a microwave oven embodying the present invention.

The construction of the present invention is described hereinafter referring to the drawings, which show the preferred embodiments of the present invention.

In FIG. 1, the enclosure case 10 comprises a heating chamber 11 wherein an object to be heated such as food is to be placed. The heating chamber 11 has a door 12 mounted by means of, e.g., hinges 13 at one e.g., left, side portion of the enclosure case 10. A control panel 14 on which a display unit 5 and control switches SW(e.g., a start/stop switch, a door open switch, etc.) may be located is provided at the other, e.g., right, side portion of the enclosure case 10. In addition, magnetic materials(e.g., ferromagnetics or permanent magnets) 20,20' are provided at one side, for example, at the right side portion of the door 12 and disposed so as to contact with the corresponding electromagnets 30,30' installed in the enclosure case 10.

Turning now to the sequence of heating operation with reference to FIG. 1, at first, the user places an object to be heated into the heating chamber 11 and then, closes the oven door 12. As the door is being closed, the permanent magnets 20,20' gets closer to the electromagnets 30,30' and as a result, currents are induced in the coils of the electromagnets 30,30'. The induced currents are used by a control circuit to detect the two closing stages of the door(i.e., when the door is being closed; and when the door is completely closed).

With the door completely closed, the control circuit will apply currents in one direction to the coils of the electromagnets 30,30' to introduce attracting forces between the permanent magnets 20,20' and the electromagnets 30,30' until either an expected(i.e., opening by pressing the door open switch) or an unexpected (i.e., opening by physical forces) opening of the door happens. Accordingly, the door can be magnetically latched once the door has been closed.

In this state, pressing the start/stop switch will initiate/end the radiation of microwaves within the heating chamber 11.

An energy generator for the generation of microwaves, under the control of the control circuit, can radiate microwaves only while the door is in the properly closed state. That is, when the door is not completely closed, the energy generator will not be initiated even if the start/stop switch is pressed. And when either the expected or the unexpected opening happens, the energy generator once initiated will stop its microwave radiating operation.

When the user presses the door open switch to remove the heated object from the heating chamber 11, currents will be applied for a period in a reverse direction to the coils of the electromagnets 30,30' to introduce strong repelling forces between the permanent magnets 20,20' and the electromagnets 30,30'. Consequently, the oven door can be opened without any intervening physical forces.

When the door is being opened expectedly or unexpectedly, the permanent magnets 20,20' will gradually become distanced from the electromagnets 30,30'; and, as a result, currents are induced in the coils of the electromagnets 30,30' in the opposite direction to the previous one. The induced currents are used by the control circuit to detect the two opening stages of the door (i.e., when the door is being opened; and when the door is completely opened).

Further, the control circuit will generate a buzzer sound with an appropriate indication on the display unit 5 when: the door is not completely closed, the door is being opened unexpectedly; or the door is not completely opened upon the pressing of the door open switch.

Figure 2:
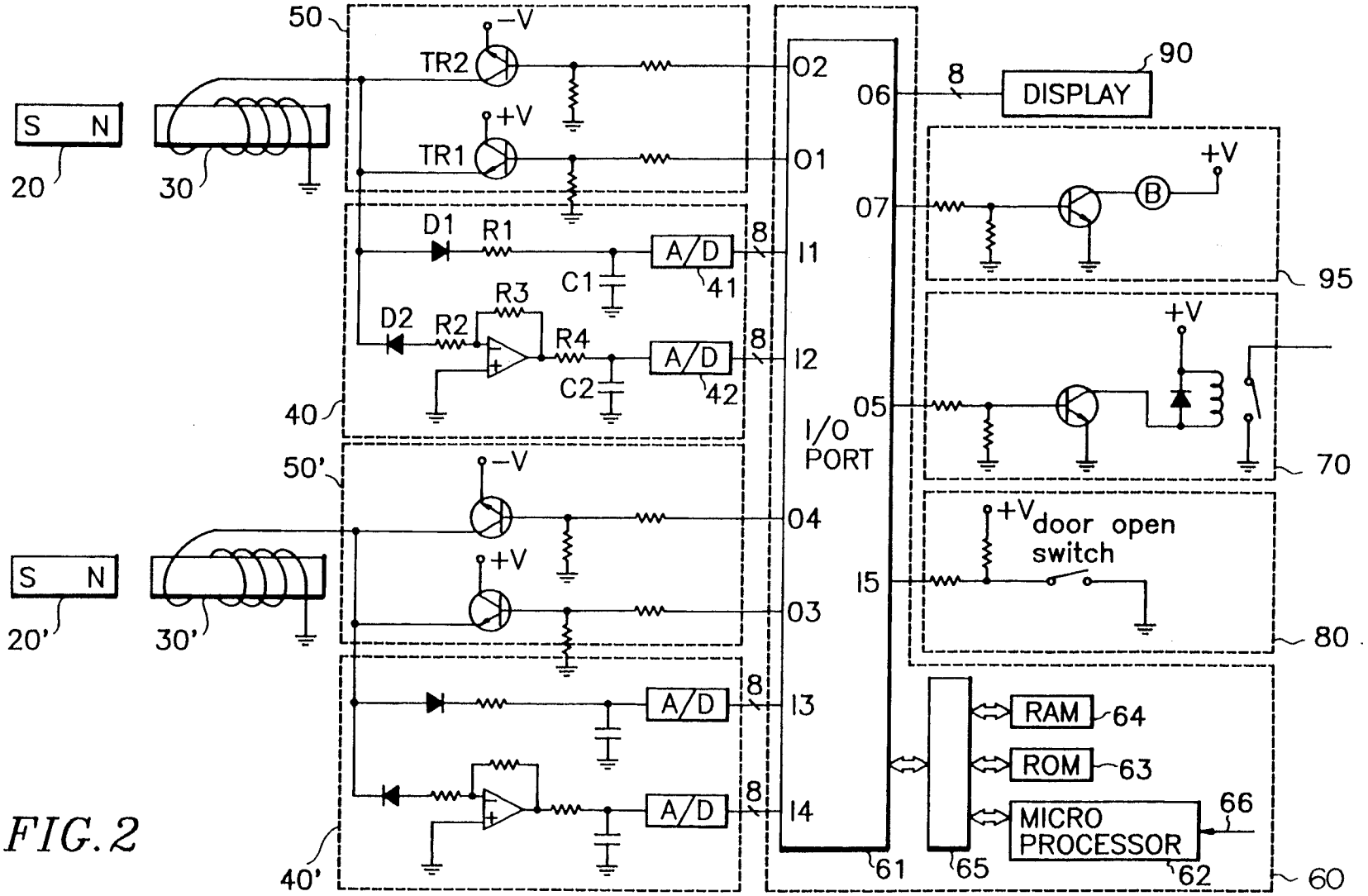
FIG. 2 depicts a control circuit diagram of the embodiment.

FIG. 2 shows the control circuit diagram of an exemplary embodiment of the present invention.

In FIG. 2, each of the electromagnets 30,30' is connected with the door state detecting means 40 or 40' and the door latching/opening means 50 or 50'. The door state detecting means 40(40') is also connected to the lines $I_1(I_3)$ and $I_2(I_4)$ of the I/O port 61 of the processing means 60. And the door latching/opening means 50(50') is also connected to the lines $O_1(O_3)$ and $O_2(O_4)$ of the I/O port 61.

Figure 3A:
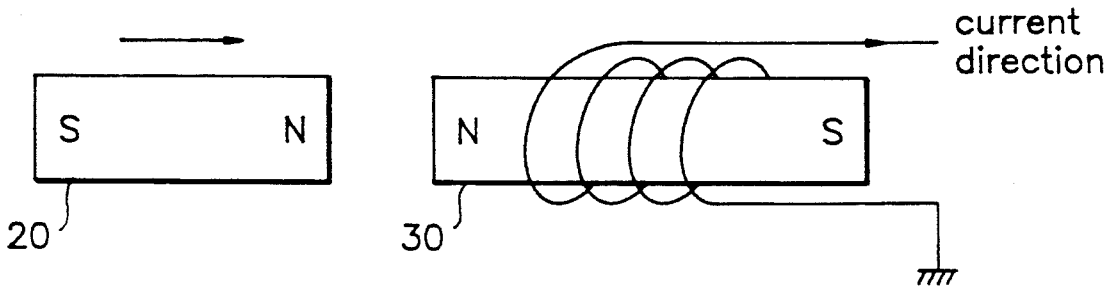
FIGS. 3A and 3B describes the respective directions of the currents induced in the coil of an electromagnet when a permanent magnet moves horizontally to and from the electromagnet.
Figure 3B:
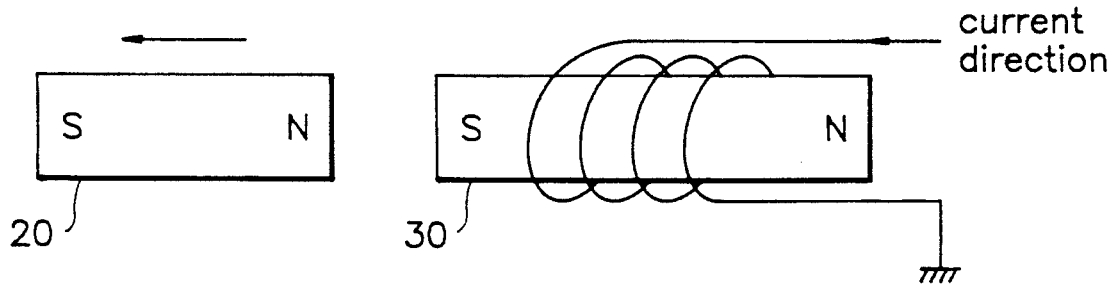

The door state detecting means 40 preferably comprises a diode $D_1$, a resistor $R_1$, a condenser $C_1$ and an A/D converter 41 in one part and a diode $D_2$, resistors $R_2$,$R_3$,$R_4$, a condenser $C_2$, an amplifier $OP_1$, and an A/D converter 42 in the other part as shown in FIG. 2. Referring to FIGS. 2 and 3, the operations of the door state detecting means 40 will now be fully described. In the first place, we will assume the oven door is being closed. As the door is being closed, the permanent magnet 20 with the pole directions shown in FIGS. 2 and 3 approaches the electromagnet 30; and, as a result, electric current is induced in the coil of the electromagnet 30 in the direction shown in FIG. 3A. The induced current will flow from the coil to the A/D converter 41 through the diode $D_1$, the resistor $R_1$ and the condenser $C_1$. Hence, the voltage across the condenser $C_1$ will be applied to the A/D converter 41 as an input voltage thereof. Further, as the permanent magnet 20 approaches the electromagnet 30, the induced emf(electromotive force) will gradually be increased and so will the voltage across the condenser $C_1$. Accordingly, the voltage has its peak value at the point of time just before the permanent magnet 20 contacts with the electromagnet 30. The A/D converter 41 then converts the time-varying analog input voltage signal to the appropriate bits(for example, 8 bits) of a digital signal. The resulting bits of digital signal will be sent in parallel through the line $I_1$ to the processing means 60 which will be described later.

Secondly, we will assume the door is being opened expectedly or unexpectedly. As the door is being opened, the permanent magnet 20 becomes more distant from the electromagnet 30; and, as a result, electric current is induced in the coil of the electromagnet 30 in the direction shown in FIG. 3B. The induced negative current is applied through the diode $D_2$ and the resistor $R_2$ to the input terminal of the inverting voltage amplifier comprising the amplifier $OP_1$ and the resistor $R_3$. Hence, the inverted positive voltage across the condenser $C_2$ will be applied to the A/D converter 42 as an input voltage thereof. Meanwhile, as the permanent magnet 20 moves away from the electromagnet 30, the absolute value of the induced emf will gradually be decreased until zero and so will the voltage across the condenser $C_2$. Accordingly, the voltage has its peak value at the point of time when the permanent magnet 20 has just departed from the electromagnet 30. The A/D converter 42 then converts the time-varying analog input voltage signal to the appropriate bits of a digital signal. The resulting bits of digital signal will also be sent in parallel through the line $I_2$ to the processing means 60.

In FIG. 2, the door latching/opening means 50 preferably comprises two transistors $TR_1$, $TR_2$. The base of the $TR_1$ is connected with the line $O_1$ of the I/O port 61 while its emitter is connected with the coil of the electromagnet 30. Accordingly, when an output signal at the line $O_1$ is high, the transistor $TR_1$ will be turned on. As a result, electric current will flow from a voltage source V to the ground through the coil of the electromagnet 30, which will introduce attracting forces between the permanent magnet 20 and the electromagnet 30. Therefore, the oven door can be magnetically latched by the output signal from the processing means 60 once the door has been closed.

On the other hand, the base of the $TR_2$ is connected with the line $O_2$ of the I/O port 61 while its collector is connected with the coil of the electromagnet 30. Accordingly, when the output signal at the line $O_2$ is high, the transistor $TR_2$ will be turned on. As a result, electric current will flow from the ground to a voltage source -V through the coil of the electromagnet 30, which will introduce repelling forces between the permanent magnet 20 and the electromagnet 30. Therefore, the oven door can be opened by the output signal from the processing means 60 upon the pressing of the door open switch.

A load driving power switching means 70 is shown on the right side to the I/O port 61. The switching means 70 comprises two resistors, a relay and a transistor whose base is connected to the line $O_5$ of the I/O port 61. Accordingly, as far as the output signal at the line $O_5$ is held high, the transistor becomes turned on and the relay makes its contact. Thereby, the switching means 70 controllably connects an AC source(not shown) to the loads(e.g., microwave generator, fan, motor, etc. also not shown) of the microwave oven. That is to say, in the event of a faulty situation i.e., when the oven door is not completely closed or when the door is opened expectedly or unexpectedly, the output signal at the line $O_5$ becomes low, which will disconnect the AC source from the loads.

A door open switch means 80 is also shown in FIG. 2 as being connected to the line $I_5$ of the I/O port 61. The door open switch means comprises a voltage divider having two resistors and the door open switch. Upon the appropriate pressing of the switch, a low signal will be applied through the line $I_5$ to the processing means 60.

A display means 90 and an alarm means 95 are also connected to the I/O port 61. The display means is shown as being connected to the line $O_6$. It comprises mainly seven-segment LED units. The alarm means is connected to the line $O_7$. It comprises two resistors, a transistor and a buzzer. These means will be activated upon the occurrence of any of the following faulty situations: when the door is not completely closed, the door is not completely opened upon the pressing of the door open switch or the door is being opened unexpectedly.

Further, the processing means 60 shown in FIG. 2 preferably comprises the I/O port 61, a microprocessor 62 with a reset terminal 66, a ROM 63, a RAM 64 and a system bus 65. Although not specifically shown, the system bus may include a data bus, an address bus and a control bus. The input and the output signals of the I/O port 61, which are mentioned hereinabove, are processed or generated by the processing means 60.

The microprocessor 62 acting as a main processing unit executes a control program stored in the ROM 63. During the program execution, relevant data will be stored in the RAM 64. Referring to FIGS. 4A, 4B1, 4B2, 4C1, 4C2 and 4D, an exemplary operation of the microprocessor 62 will now be described in accordance with the specific decision logic of the present invention. Other decision logic may also be advantageously and equally adopted and stored within the ROM 63. Further, some parts of the following sequences may be changed or eliminated for efficiency and for application in specific purposes.

Figure 4A:
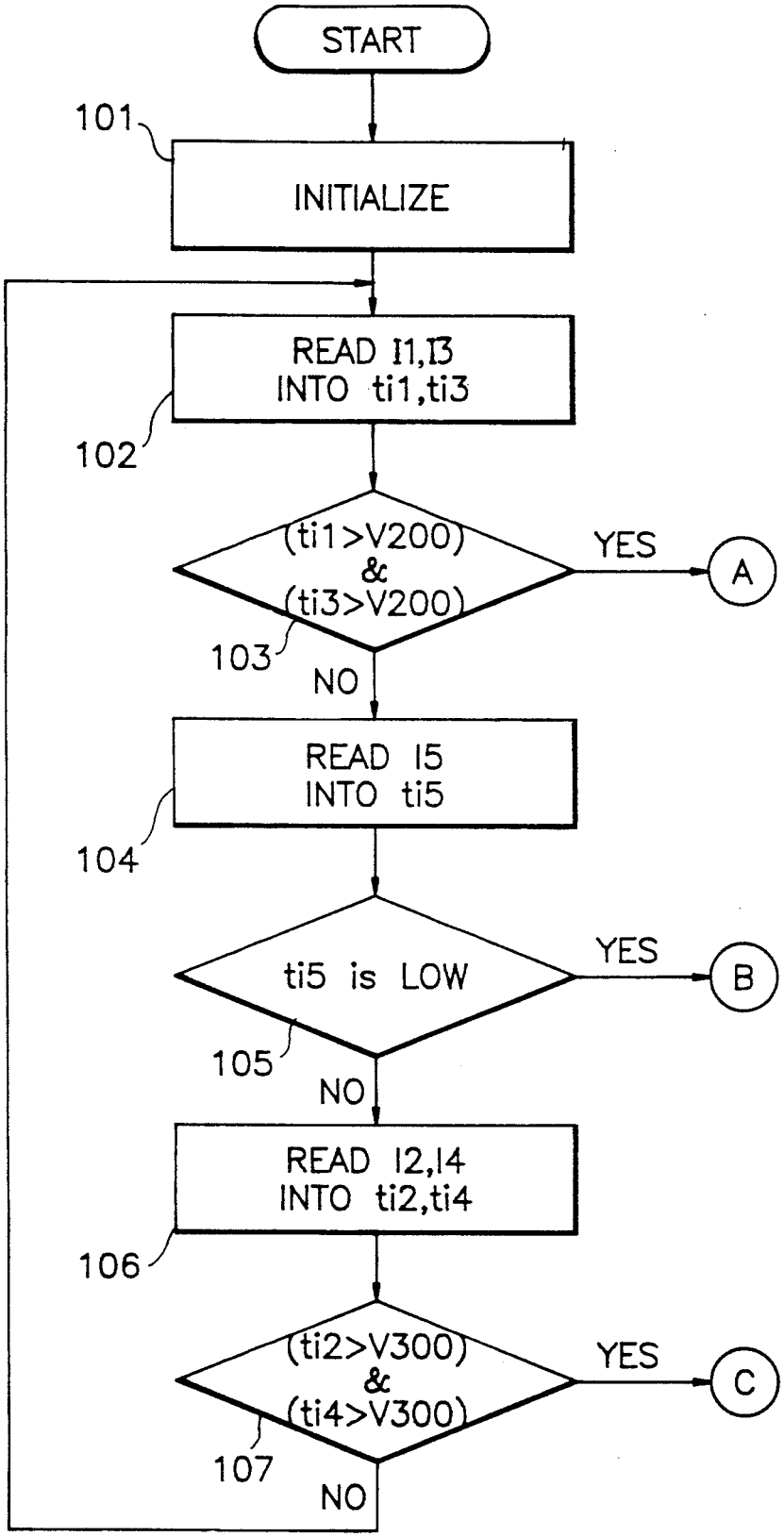

The main sequence, shown in FIG. 4A, is repeated as long as the microwave oven power is on. The sequence will be started from Block 101 after the power on or the resetting of the microprocessor 62. After an initialization, Block 102 reads the two input signals currently held at the lines $I_1$ and $I_3$ of the I/O port 61(shown in FIG. 2) into $ti_1$ and $ti_3$ stored in the RAM 64. When each of $ti_1$ and $ti_3$ exceeds a predetermined value $V_{200}$, the sequence will be diverted to the door close processing sequence shown in FIGS. 4B1 and 4B2, which will be explained later. The predetermined value $V_{200}$ stored in the ROM 63 corresponds to the least significant value from the lines $I_1$ and $I_3$, which would indicate the door being closed. The value $V_{200}$ is determined empirically.

Block 104 then reads the input signal held at the line $I_5$ of the I/O port 61 into $ti_5$ stored in the RAM 64. When the $ti_5$ is low to acknowledge that the door open switch has been pressed, the sequence will be diverted to the expected door open processing sequence shown in FIGS. 4C1 and 4C2, which will be explained later.

Block 106 then reads the two input signals currently held at the lines $I_2$ and $I_4$ of the I/O port 61 into $ti_2$ and $ti_4$ stored in the RAM 64. When each of $ti_2$ and $ti_4$ exceeds another predetermined value $V_{300}$, the sequence will be diverted to the unexpected door open processing sequence shown in FIG. 4D, which will be explained later. The predetermined value $V_{300}$ stored in the ROM 63 corresponds to the least significant value from the lines $I_2$ and $I_4$, which would indicate the door being opened. The value $V_{300}$ is determined through experiments. The main sequence from the block 102 will be repeated until the power off or the resetting of the microprocessor 62 happens.

The door close processing sequence, shown in FIG. 4B, is executed when the door is being closed as stated above. Block 201 sets variables stored in the RAM 64. That is, Block 201 assigns the $ti_1$ and the $ti_3$ to $ti_1$_max and $ti_3$_max respectively and assings current time from read time clock(not shown) to $ti_1$_max_t and $ti_3$_max_t. Block 202 then reads again the input signal currently held at the line $I_1$ of the I/O port 61 into the $ti_1$. If the $ti_1$ is greater than or equal to the $ti_1$_max previously stored, then the $ti_1$_max will be newly set to the $ti_1$ and current time will be written into the $ti_1$_max_t at Block 204. Accordingly, the $ti_1$_max will be always set to the maximum input signal from the line $I_1$ upto that point. Block 205 reads the input signal currently held at the line $I_3$ of the I/O port 61 into the $ti_3$. If the $ti_3$ is greater than or equal to the $ti_3$_max, then the $ti_3$_max will be newly set to the $ti_3$ and current time will be written into the $ti_3$_max_t at Block 207. Thereafter, the subsequence from Block 202 to Block 208 will be repeated until both the $ti_1$ and the $ti_3$ drop to zero.

Block 209 determines whether all of the following three conditions are met: both the $ti_1$_max and the $ti_3$_max are greater than another predetermined value $V_{250}$, the $ti_1$_max is equal to the $ti_3$_max within the predetermined permissable boundary $E_{200}$; and the $ti_1$_max_t is equal to the $ti_3$_max_t within another predetermined permissible boundary $E_{250}$. The predetermined value $V_{250}$ stored in the ROM 63 corresponds to the least significant value from the lines $I_1$ and $I_3$, which would indicate the door is completely closed. The predetermined value $E_{200}$ also stored in the ROM 63 is provided for compensating the errors which may come from the time interval between the readings of the line $I_1$ and the line $I_3$, the differences in the characteristics of the A/D converters (shown in FIG. 2), etc. The predetermined value $E_{250}$ stored in the ROM 63 stands for similar purposes. The predetermined values $V_{250}$, $E_{200}$, $E_{250}$ should be set through experiments. If all of the three conditions are met, it can be recognized that the door is completely closed. Hence, Block 210 provides a high signal for each of the lines $O_1$ and $O_3$ of the I/O port 61 to magnetically latch the door until either an expected or an unexpected opening happens. Block 210 also provides another high signal at the line $O_5$ of the I/O port 61 to make it possible to connect the AC power to the loads of the microwave oven. In this state, pressing the start/stop switch will initiate/end the radiation of electromagnetic energy.

On the other hand, if any of the three conditions is not met, it can be recognized that the door is not completely closed because, for example, some alien substance has intervened between the permanent magnets 20,20' (shown in FIG. 2) and the electromagnets 30,30' (also shown in FIG. 2). Therefore, Block 211 generates an appropriate display signal at the line $O_6$ of the I/O port 61 to tell the user that the door is not completely closed and provides a high signal for the line $O_7$ of the I/O port 61 to make a buzzer sound. The display means 90 and the alarm means 95 (shown in FIG. 2) will be activated until the user fixes the fault and resets the microprocessor 62 by using the reset terminal 66

(shown in FIG. 2). Finally, at Block 212, return to the main sequence is performed.

The expected door open processing sequence, shown in FIGS. 4C1 and 4C2, is executed when the door open switch has been pressed as stated above.

At first, Block 301 assigns current time to a variable $t_0$ stored in the RAM 64. Then, at Block 302, the high signal which was provided for each of the lines $O_1$ and $O_3$ to magnetically latch the door becomes low. Further, the high signal which was provided at the line $O_5$ of the I/O port 61 falls low to cut out the AC power from the loads of the microwave oven. Block 303 then provides a high signal for each of the lines $O_2$ and $O_4$ of the I/O port 61 to introduce repelling forces between the permanent magnets 20,20' and the electromagnets 30,30'. Block 304 then reads the two input signals currently held at the lines $I_2$ and $I_4$ of the I/O port 61 into the $ti_2$ and the $ti_4$. When each of the $ti_2$ and the $ti_4$ exceeds the predetermined value $V_{300}$, Block 308 will be entered. The predetermined value $V_{300}$ together with the meaning thereof has already been mentioned in the context of the main sequence.

If the condition is not met, the time limit must be checked at Blocks 306 and 307. That is, Block 306 assigns current time to a variable $t_1$ stored in the RAM 64 and then, Block 307 determines whether $(t_1-t_0)$ is above a time limit $T_1$ stored in the ROM 63; in other words, whether the door does not begin to open until the predetermined time limit $T_1$ elapsed. If the condition is not met, the subsequence from Block 303 will be repeated. If the condition is met, Block 313 will be entered, which will be described hereinafter.

At Block 308, the high signal which was provided for each of the lines $O_2$ and $O_4$ to introduce repelling forces between the permanent magnets 20,20' and the electromagnets 30,30' falls low. Block 309 then again reads the two input signals currently held at the lines $I_2$ and $I_4$ of the I/O port 61 into the $ti_2$ and the $ti_4$. Thereafter, Block 310 assigns current time to a variable $t_2$ stored in the RAM 64. Block 311 then determines whether both the $ti_2$ and the $ti_4$ are zero. If the condition does not hold, the subsequence from the block 309 will be repeated.

On the other hand, if the condition does hold, Block 312 will be entered. Block 312 determines if $(t_2-t_0)$ (which corresponds to the period that the door is being opened) is above another predetermined time limit $T_2$ stored in the ROM 63. The time limit $T_2$ must be long enough that it can be recognized that the door has been successfully opened without interruption. If the $(t_2-t_0)$ is above the time limit, recognizing that the door is opened successfully, the sequence will be returned to the main sequence at Block 314.

However, if it is not true, assuming that some interruption has been made during the period, the sequence will execute Block 313. Block 313 will generate an appropriate display signal at the line $O_6$ of the I/O port 61 to tell the user that the door is not completely opened, and provide a high signal at the line $O_7$ of the I/O port 61 to make a buzzer sound. The display means 90 and the alarm means 95 will be activated until the user fixes the fault and resets the microprocessor 62.

Figure 4D:
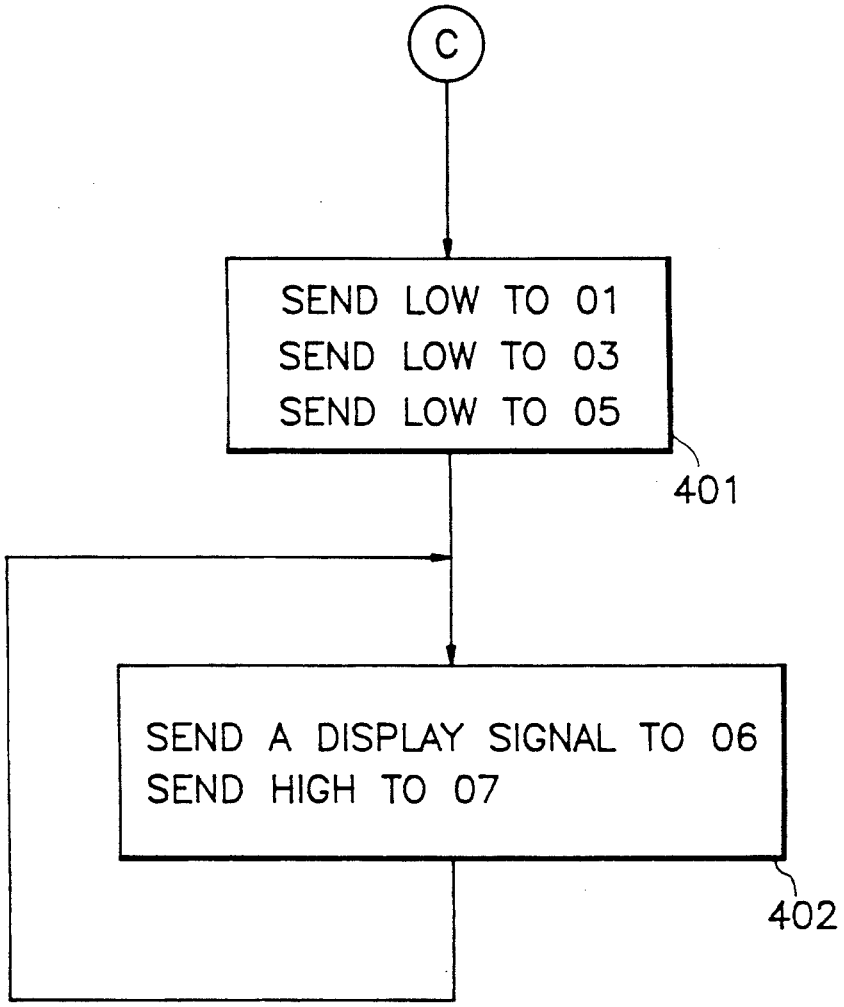

FIG. 4D shows the unexpected door open processing sequence. The sequence will be entered when the door is being opened unexpectedly as stated above.

At Block 401, the high signal which was provided for each of the lines $O_1$ and $O_3$ of the I/O port 61 to magnetically latch the door falls low. Further, the high signal which was provided at the line $O_5$ of the I/O port 61 falls low to cut out the AC power from the loads of the microwave oven. Block 402 generates an appropriate display signal at the line $O_6$ of the I/O port 61 to tell the user that the door is being opened unexpectedly, and provides a high signal at the line $O_7$ of the I/O port 61 to make a buzzer sound. The display means 90 and the alarm means 95 will be activated until the user fixes the fault and resets the microprocessor 62.

The above-described arrangements are, of course, merely illustrative of the application of the principles of the invention. Other arrangements may be devised by those skilled in the art without departing from the spirit or scope of the invention. For example, it will be appreciated that it may be advantageous in certain application to employ more than two pairs of magnetic material and electromagnet with a corresponding number of door state detecting means and door latching/opening means. Also, the processing means can advantageously be replaced by a hard-wired logic circuit.

Again, it is to be understood that the invention is not to be limited to the disclosed embodiments; but, on the contrary, it is intended to cover various modifications and equivalent arrangements included within the spirit and scope of the appended claims.

What is claimed is:

1. A microwave oven comprising:

an enclosure having therein a heating chamber adapted to receive an object to be heated;

a door mounted at an opening of the heating chamber;

at least two magnetic materials provided at one side of the door;

at least two electromagnets provided on the enclosure and adapted to contact with the respective magnetic materials;

at least two door state detecting means each connected with one of the electromagnets for generating a first signal based on electromotive forces, said electromotive forces being generated in the electromagnets when the door is being closed or opened;

a door open switch means for generating a second signal, said second signal being generated upon pressing a door open switch;

a processing means for generating in response to the first signal and the second signal a first control signal when the door is closed and a second control signal when the door is to be opened;

at least two door latching and opening means each connected with one of the electromagnets for latching and opening the door in response to the first and the second control signals, said door being latched by applying an electric current to the electromagnets in one direction and opened by applying another electric current to the electromagnets in another direction;

a microwave energy generator adapted to radiate energy within the enclosure; and a load driving power switching means for activating the generator in response to the first control signal.

2. The microwave oven as set forth in claim 1 further comprising:

a second processing means for generating a display signal in response to the first signal and the second signal; and a display means for displaying a faulty symbol in response to the display signal, said symbol being displayed when a corresponding faulty state of the door occurs.

3. The microwave oven as set forth in claim 1 further comprising:

a second processing means for generating a second control signal in response to the first signal and the second signal; and an alarm means for generating an alarm sound in response to the second control signal, said alarm sound being generated when a fauty state of the door occurs.

4. The microwave oven as set forth in claim 1 wherein said processing means comprises at least one input/output port, one microprocessor and one memory.

5. The microwave oven as set forth in claim 1 wherein said magnetic material is a permanent magnet or a ferromagnetic.

6. The microwave oven as set forth in claim 1 wherein said processing means further comprises means for detecting the state of the door when the respective first signals reach a same maximum value exceeding a predetermined value at the same time.

7. A microwave oven comprising:

an enclosure having therein a heating chamber adapted to receive an object to be heated;

a door mounted at an opening of the heating chamber;

at least two magnetic materials provided at one side of the door;

at least two electromagnets provided on the enclosure and adapted to contact with the respective magnetic materials;

at least two door state detecting means each connected with one of the electromagnets for generating a signal based on electromotive forces, said electromotive forces being generated in the electromagnets when the door is being closed or opened;

a processing means for generating a control signal in response to the signal when the door is closed;

a microwave energy generator adapted to radiate energy within the enclosure; and a load driving power switching means for activating the generator in response to the control signal.

8. The microwave oven as set forth in claim 7 further comprising:

a second processing means for generating a display signal in response to the signal; and a display means for displaying a faulty symbol in response to the display signal, said symbol being displayed when a corresponding faulty state of the door occurs.

9. The microwave oven as set forth in claim 7 further comprising:

a second processing means for generating a second control signal in response to the signal; and an alarm means for generating an alarm sound in response to the second control signal, said alarm sound being generated when a fauty state of the door occurs.

10. The microwave oven as set forth in claim 7 wherein said processing means comprises at least one input/output port, one microprocessor and one memory.

11. The microwave oven as set forth in claim 7 wherein said magnetic material is a permanent magnet or a ferromagnetic.

12. The microwave oven as set forth in claim 7 wherein said processing means further comprises means for detecting the state of the door when the respective signals reach a same maximum value exceeding a predetermined value at the same time.

* * * * *